US007048123B2

(12) United States Patent
Xiong et al.

(10) Patent No.: US 7,048,123 B2
(45) Date of Patent: May 23, 2006

(54) PRODUCT CONTAINER WITH REMOVABLY ATTACHED MAGNET

(75) Inventors: Wade W. Xiong, Salt Lake City, UT (US); Danyi Quan, Salt Lake City, UT (US)

(73) Assignee: XEL Herbaceuticals, Ibc, Salt Lake City, UT (US)

( * ) Notice: Subject to any disclaimer, the term of this patent is extended or adjusted under 35 U.S.C. 154(b) by 15 days.

(21) Appl. No.: 10/919,521

(22) Filed: Aug. 15, 2004

(65) Prior Publication Data

US 2006/0071014 A1 Apr. 6, 2006

(51) Int. Cl.
*B65D 73/00* (2006.01)

(52) U.S. Cl. ..... 206/470; 206/459.5; 206/818

(58) Field of Classification Search ..... 206/461, 206/818, 464–471, 459.5; 40/600, 711
See application file for complete search history.

(56) References Cited

U.S. PATENT DOCUMENTS 3,032,926 A * 5/1962 Lang ..... 206/461
3,051,130 A * 8/1962 Morris ..... 206/818
4,100,684 A * 7/1978 Berger ..... 206/818
4,569,462 A 2/1986 Belokin
5,351,813 A 10/1994 Golovan
5,358,770 A * 10/1994 Evans ..... 40/600
5,642,837 A 7/1997 Hays et al.
5,884,456 A * 3/1999 Hansen ..... 206/461
6,665,972 B1 12/2003 Hensel

* cited by examiner

*Primary Examiner*—Luan K. Bui
(74) *Attorney, Agent, or Firm*—Thorpe North & Western, LLP

(57) ABSTRACT

A product container configured to be magnetically affixed to a support surface to contain and dispense a product in a location adjacent to the support surface includes an enclosure configured to contain the product and to provide for dispensing of the product therefrom. An access opening is formed in at least one side of the enclosure, the access opening being configured to provide access to the product to allow an individual to withdraw the product from the enclosure. A magnet is re-usably attached to the enclosure and is configured to magnetically affix the enclosure to the support surface. The magnet has indicia disposed thereon to convey information relating to the product.

14 Claims, 4 Drawing Sheets

PRODUCT CONTAINER WITH REMOVABLY ATTACHED MAGNET

BACKGROUND

The present invention relates generally to containers for containing and dispensing products. In particular, the present invention relates to product dispensing containers having magnets attached thereto to allow the container to be magnetically affixed to a support surface.

Those who produce and distribute products are often faced with the problem of how best to promote their products. Commonly known conventional advertising and promotional methods that have been used for many years include: print advertisements, radio and television advertisements, on-site advertising, etc. However, such methods have proved disadvantageous in that they are often limited to particular geographical areas, specific demographic groups, and availability of particular media. Such methods have also proven overly costly and speculative, and are generally limited to pre-sales activities of consumers in an effort to entice consumers to purchase a particular product for use in the consumers' homes.

While conventional promotional methods have proved at least partially effective, it is believed that such methods lack sustained promotional valued once the product has been brought into consumers' homes. For example, many products that are purchased are placed on a shelf or in a cupboard of a home and are largely forgotten by consumers over time. These types of products are not as likely to be consumed, and subsequently repurchased, as are products that remain on the minds of consumers. In addition, once a sale of a product has been made and the product has been depleted by the consumer, the consumer may not remember to purchase additional quantities of the product unless exposed to additional promotional materials.

SUMMARY

It has been recognized that it would be advantageous to develop a system and method for promoting a product that is integrated with the product and remains in consumers' homes after the product has been depleted by the consumer.

The present invention provides a product container configured to be magnetically affixed to a support surface to contain and dispense a product in a location adjacent to the support surface. The container can include an enclosure, configured to contain the product and to provide for dispensing of the product therefrom. An access opening can be formed in at least one side of the enclosure to provide access to the product to allow an individual to withdraw the product from the enclosure. A magnet can be re-usably attached to the enclosure and can be configured to magnetically affix the enclosure to the support surface. The magnet can have indicia disposed thereon, the indicia conveying information relating to the product.

In accordance with another aspect of the invention, a product container configured to be magnetically affixed to a support surface to contain and dispense a product in a location adjacent to the support surface is provided. The container can include an enclosure, configured to contain the product and to provide for dispensing of the product therefrom. An access opening can be formed in at least one side of the enclosure and a magnet can be re-usably attached to the enclosure. The magnet can have at least two configurations: i) a support configuration in which the magnet is non-magnetically attached to the enclosure and magnetically affixes the enclosure to the support surface; and ii) a decorative configuration, in which the magnet is removed from the enclosure and is magnetically affixed to the support surface without the enclosure as a decorative magnet independent from the enclosure.

In accordance with another aspect of the invention, a method for promoting a product contained in a container is provided, including the steps of: magnetically affixing the container to a support surface with a magnet re-usably and non-magnetically attached to the container, said magnet having indicia disposed thereon conveying information relating to the product; removing the container from the support surface after use of the container; removing the magnet from the container; and magnetically affixing the magnet to the support surface independently of the container to display the indicia conveying information relating to the product to promote the product in absence of the container.

The method can include the further steps of magnetically affixing a second container to the support surface with a second magnet re-usably and non-magnetically attached to the second container, said second magnet having a second indicia disposed thereon conveying information relating to a second product; removing the second container from the support surface after use of the second container; removing the second magnet from the second container; and magnetically affixing the second magnet to the support surface independently of the second container to display the second indicia conveying information relating to the product to promote the second product in absence of the second container.

In accordance with another aspect of the invention, a method for promoting a product is provided, including the steps of: disposing the product within a container, the container having an access opening in at least one side of the container to provide access to the product within the container; and re-usably attaching a magnet to the container to enable the container to be magnetically affixed to a support surface; the magnet having indicia disposed thereon conveying information relating to the product and having at least two configurations: i) a support configuration in which the magnet is non-magnetically attached to the container and magnetically affixes the container to the support surface; and ii) a decorative configuration, in which the magnet is removed from the container and is magnetically affixed to the support surface without the container as a decorative magnet independent from the container.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENTS

Figure 2:
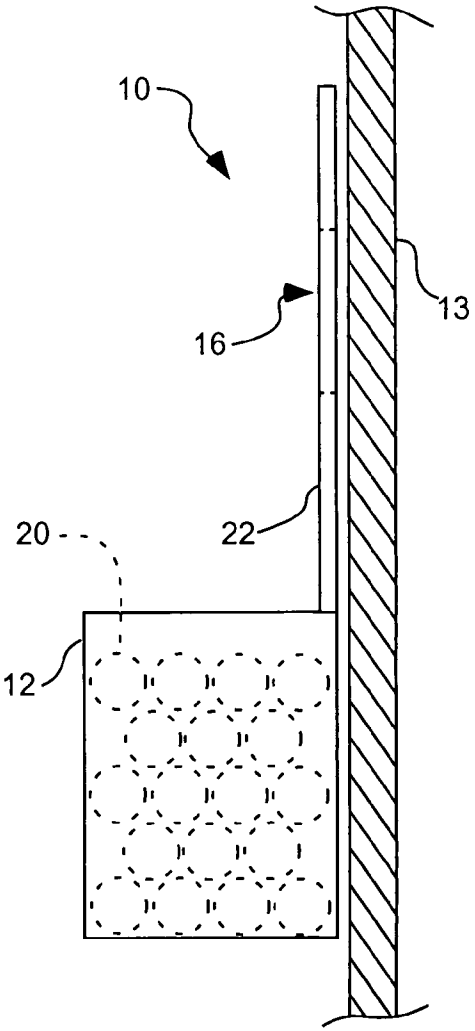
FIG. 2 is a side view of the container of FIG. 1, taken from the right side of FIG. 1, affixed to a support surface.
Figure 1:
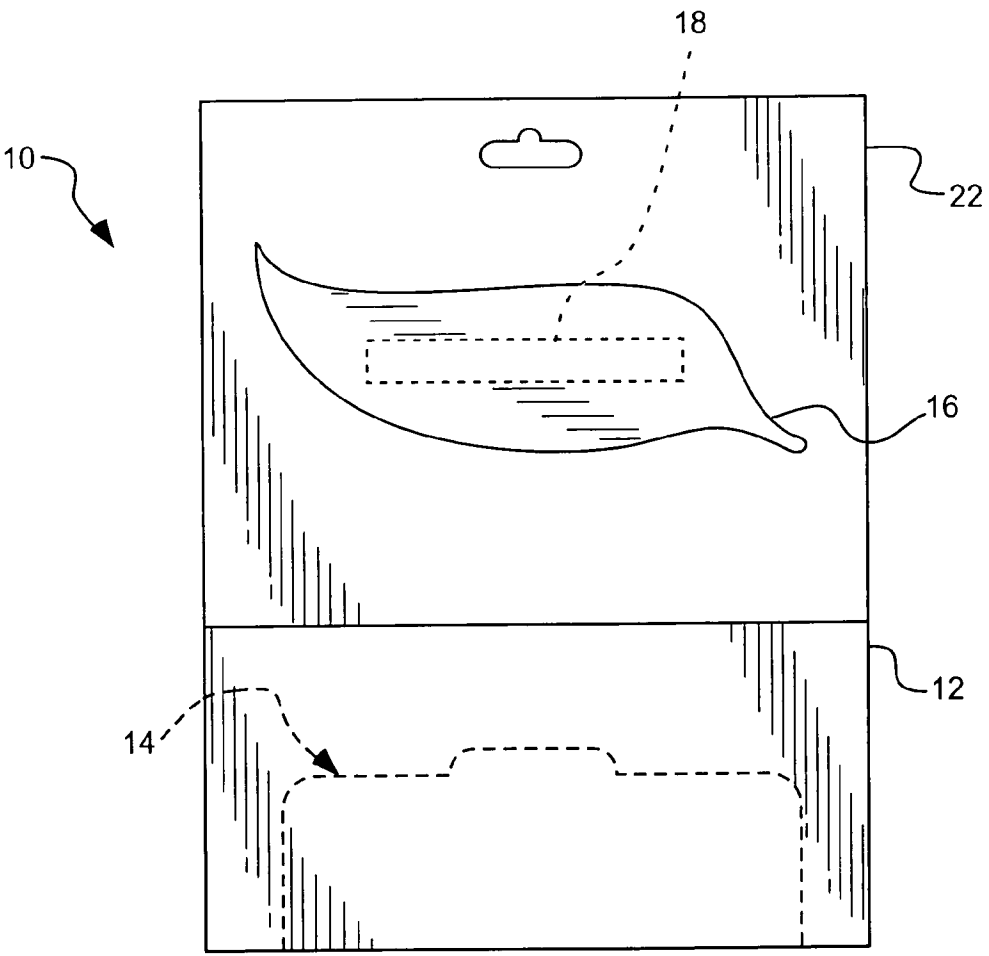
FIG. 1 is a front view of a product container with a magnet re-usably attached thereto in accordance with an embodiment of the present invention.

As illustrated generally at 10 in FIGS. 1 and 2, in one exemplary embodiment of the present invention a product container is provided. The container can be configured to be magnetically affixed to a support surface (13 in FIG. 2) to contain and dispense a product (20 in FIG. 2) in a location adjacent to the support surface. The container can include an enclosure 12 which can be configured to contain the product and to provide for dispensing of the product therefrom. An access opening 14 can be formed in at least one side of the enclosure. The access opening can be configured to provide access to the product to allow an individual to withdraw the product from the enclosure. A magnet 16 can be re-usably attached to the enclosure, or to the container, in a variety of locations and can be configured to magnetically affix the enclosure to the support surface. The magnet can include indicia (shown schematically for exemplary purposes at 18 in FIG. 1) disposed thereon to convey information relating to the product.

The container 10 can be used to contain and dispense a variety of products 20 and can include a re-usably attached magnet 16 having a variety of types and configurations of indicia 18 disposed thereon. As used herein, the term "indicia" is to be understood to refer to information displayed in a variety of manners, including textual information, pictorial information, trademarks, logos, drawings, artwork, poetry, phrases, idioms, etc. In one aspect of the invention the indicia can relate to the product contained within the container, and can convey, for example: the type of product contained in the container; the manufacturer or distributor of the product; laudatory aspects of the product; health attributes associated with the product; history behind the product; flavor or formulation of the product, etc. The indicia can also convey information unrelated to the product, for example, arbitrary selections of poetry, famous artwork, historical subject matter, etc.

While not so limited, the present invention can provide a magnet 16 that is re-usably attached to the container 10 and that is used to promote the product 20 contained in the container. For example, the product can contain individual packets of a beverage concentrate that can be added to water to form the beverage. The container can be purchased by a consumer and affixed, for example, to the consumer's refrigerator to remind the consumer of the presence of the beverage within the consumer's kitchen. The magnet that is re-usably attached to the product container can include indicia thereon that can be visible on the container as the container is magnetically affixed to the support surface (in this case the refrigerator door), as shown for example by the embodiment illustrated in FIGS. 1 and 2.

As discussed above, the support surface 13 can be, for example, a metallic door of a consumer's refrigerator which can be used to display and promote products from a central location of the consumer's dwelling. In addition, the support surface can be of a wide variety of surfaces to which a container can be magnetically affixed. Examples of suitable surfaces include medicine cabinets, interior or exterior doors, etc. In the case where the desired support surface is not ferromagnetic, for example, a glass door or window, a sheet of metal or other ferromagnetic material can be attached to, or otherwise disposed adjacent to, the surface to enable magnetic affixation of the container to the surface. Thus, support surfaces of the present invention can be metallic, partially metallic, ferromagnetic and partially ferromagnetic.

In the embodiment shown in FIGS. 1 and 2, the magnet 16 is integrated with a portion of the container 10 in a manner that allows the magnet to be re-usably detached from the container. In this manner, after the product 20 is depleted from the container (or after the consumer desires to remove the container from the refrigerator support surface 13 regardless of the amount of product remaining in the container), the magnet can be removed from the container and can be magnetically affixed to the support surface independently of the container, as illustrated by example in FIGS. 4A through 4C. As the magnet can retain the indicia disposed thereon after being removed from the container, the magnet can be used to display the indicia conveying information relating to the product to promote the product even in the absence of the container. In this manner, the removable magnet continues to promote the product even after the container is discarded, serving, for example, as a reminder that the consumer should replenish his or her supply of the product.

It will be appreciated that the present invention provides a method by which a container can be magnetically affixed to a support surface while also providing a magnet having indicia thereon which can serve a decorative, promotional or advertising purpose as well. For example, in addition to providing a manner in which the container can be magnetically affixed to the support surface, the re-usably attached magnet can include indicia related to other magnets affixed to related product containers. In this aspect of the invention, a series of "collectable" magnets can be distributed on related products, and product containers, and can provide consumers the opportunity to collect or obtain all magnets in a particular series by purchasing an entire line of product types. The collectable magnets can also be used as conventional magnets are often used in kitchens, i.e., to affix notes, photos, children's drawings, etc., to a support surface such as a front of a door of a refrigerator.

Figure 2B:
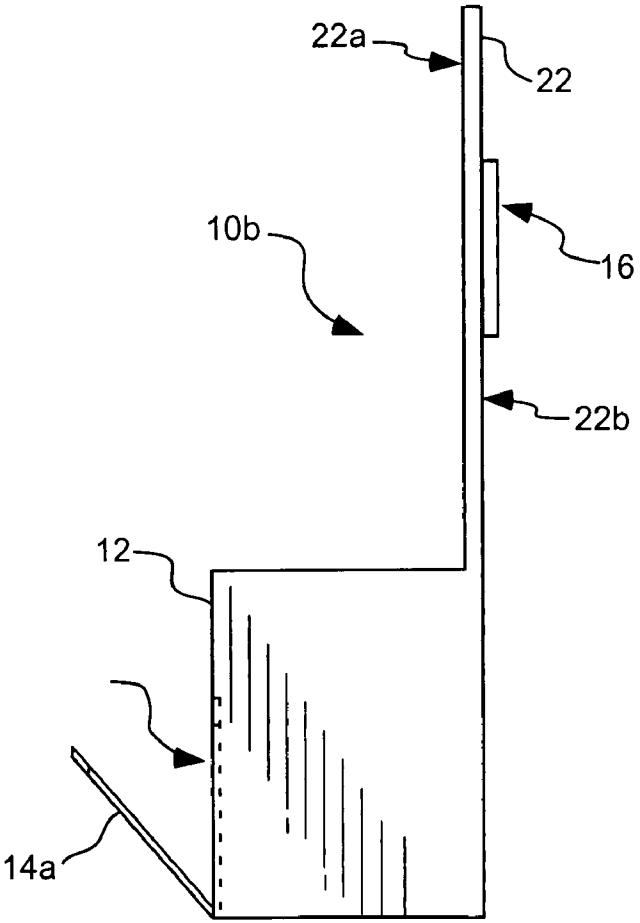
FIG. 2B is a side view of another embodiment of a container in accordance with the present invention.
Figure 2A:
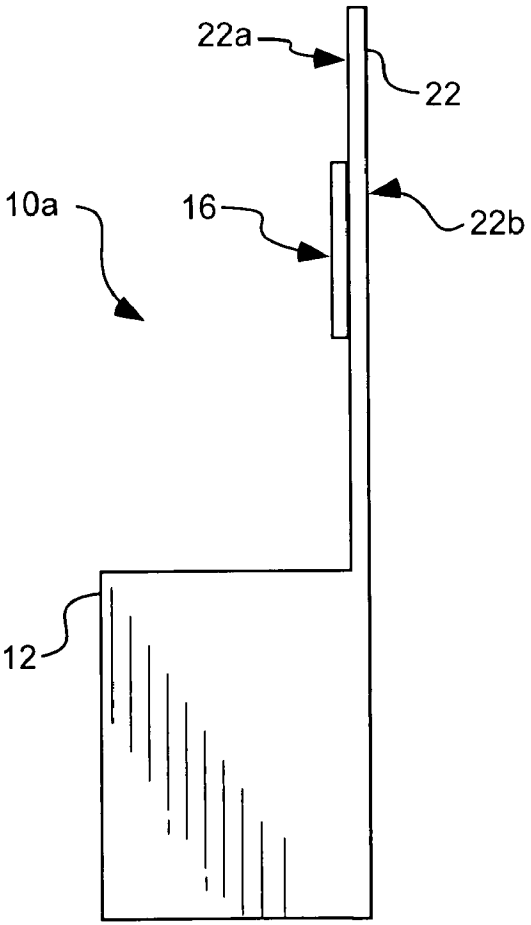
FIG. 2A is a side view of another embodiment of a container in accordance with the present invention.

FIGS. 2A and 2B illustrate alternate embodiments 10*a*, 10*b*, respectively, of containers in accordance with the present invention in which the magnet 16 is disposed in various positions on the container. In these aspects of the invention (as well as that shown in FIG. 1), the container can include a display panel 22 which can be attached to or can extend from the enclosure 12. The display panel can include information (not shown) relating to the product, including, for example, contents of the container, amount of product contained, product type or formulation, etc. The embodiment of the invention illustrated in FIG. 2A includes the re-usably attached magnet 16 disposed on a frontward (with respect to the enclosure 12) side 22*a* of the display panel. In this aspect, the magnet, and accordingly, the indicia 18, can be viewed from the front of the container while the magnet is still attached to the container and also while the container is attached to a support surface (13 in FIG. 2).

In the embodiment shown in FIG. 2B, the magnet 16 is disposed on a rearward (with respect to the enclosure 12) side 22*b* of the display panel 22. In this aspect of the invention, the magnet (and thus the indicia disposed on the magnet) may or may not be visible while the container 10*b* is affixed to the support surface 13 with the magnet. In addition, the magnet may be disposed within the container or enclosure (i.e., hidden from view within the packaging). In either of the embodiments of FIGS. 2A and 2B, however, the indicia 18 disposed on the magnet 16 can be visible while the magnet is independently affixed to the support surface after being re-usably detached from the container. While the indicia 18 shown in FIG. 1 is disposed on a frontward side of the magnet, it is to be understood that the indicia can be disposed on a variety of sides of the magnet, including a front or a back side of the magnet. The indicia can be disposed on only side of the magnet: or on at least two sides of the magnet, so as to be visible from whichever side is exposed to view while the magnet is affixed to a support surface.

As used herein, the term "re-usably" attached is to be understood to refer to a relationship between the magnet and the container such that, when the magnet and container are attached to each other, a bond exists between the two that is sufficiently strong so as to hold the magnet on the container, yet is sufficiently temporary so as to allow the magnet to be removed from the container and used independently from the container on a support surface. Examples of attachment methods which can result in a magnet being re-usably attached to the container include, without limitation, thermoset adhesives, "removable adhesives," etc., as would occur to one skilled in the art. A magnet that is "re-usably" attached to a container can be removed from the container without resulting in significant structural or aesthetic damage to either the container or the magnet.

Re-usably attached magnets 16 in accordance with the present invention can be formed from a variety of material and in a variety of shapes. The magnets can be formed from a relative soft and pliable material, which can allow the magnet to flex with the product container without incurring significant damage. The magnets can also be formed from a relatively stiff material, which can provide a magnet with an increased magnetic force in order to securely affix a relatively heavy container to or on the support surface. In addition, while embodiments of the invention shown include a single magnet, a plurality of magnets can also be used to allow a manufacturer or a packager to customize the collective holding strength of the magnets to ensure a sufficiently strong magnetic bond between the container and the support surface.

Figure 4A:
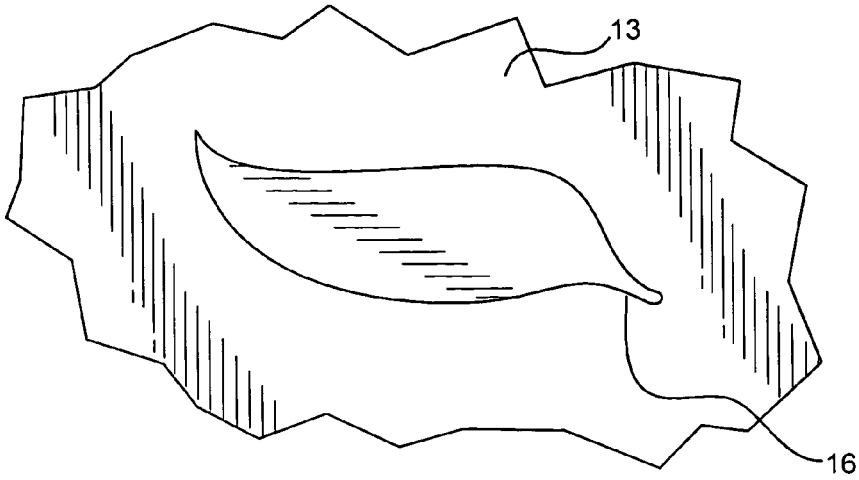
FIG. 4A is a representative shape of a magnet in accordance with an aspect of the invention, the magnet being affixed to a section of a support surface.
Figure 4B:
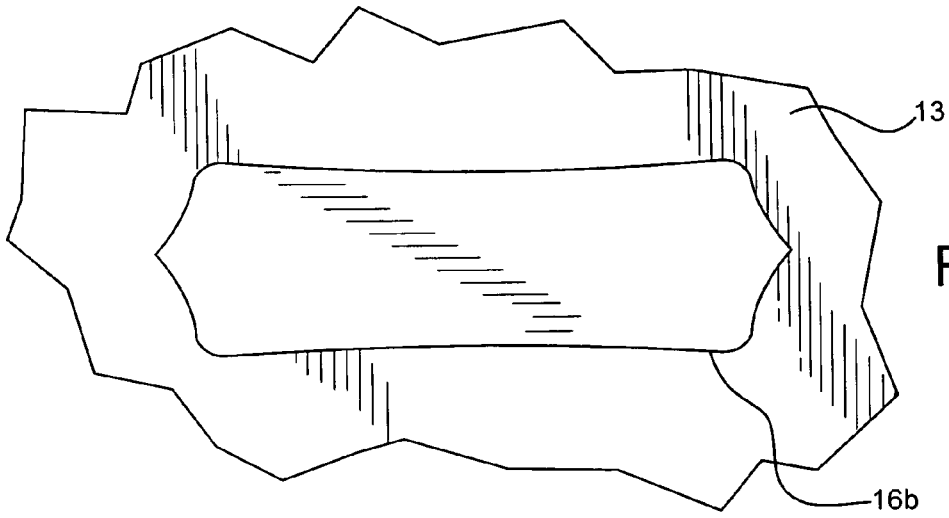
FIG. 4B is a representative shape of a magnet in accordance with another aspect of the invention, the magnet being affixed to a section of a support surface.
Figure 4C:
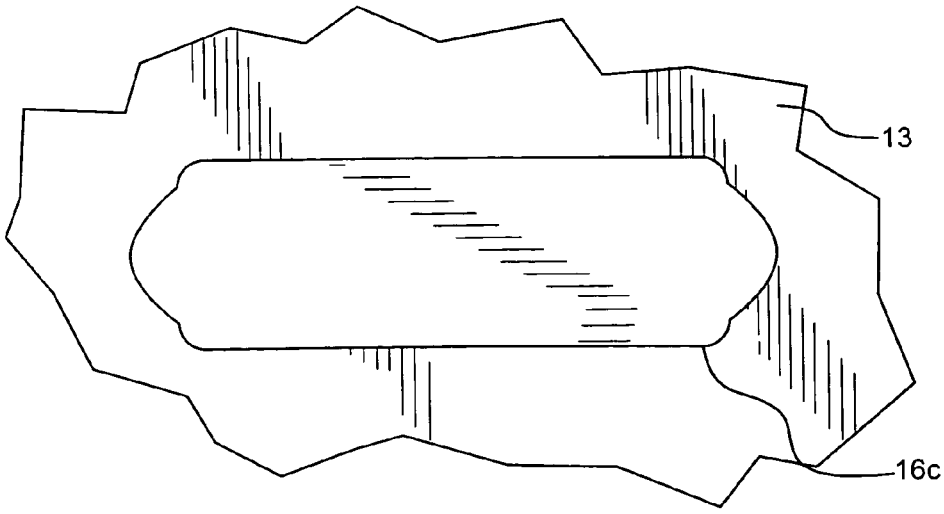
FIG. 4C is a representative shape of a magnet in accordance with another aspect of the invention, the magnet being affixed to a section of a support surface.

The shape of the magnet can take a variety of forms as well. In one aspect of the invention the magnet includes a decorative shape to provide a more pleasing aesthetic appearance. Decorative shapes of the magnets can include, without limitation: a logo, a plant, an animal, a portion of a plant, a portion of an animal, a tea leaf, a curvilinear closed shape, and a variety of other aesthetically pleasing shapes. FIGS. 4A through 4C illustrate various decorative shapes in which the magnet can be formed, with each of the magnets being affixed to a portion of an underlying support surface 13.

Containers 10 in accordance with the present invention having a magnet 16 re-usably attached thereto can be used in connection with a variety of products. In one aspect of the invention, the product can include tea and/or tea supplements. The tea can be provided in an "instant" formulation which can be added to hot or cold water to form a liquid tea product. The product contained in the container can also take a variety of additional forms, such as dietary supplements, pharmaceuticals, nutraceuticals, medications, cosmetics, paper products, food products, snacks, etc.

Figure 3:
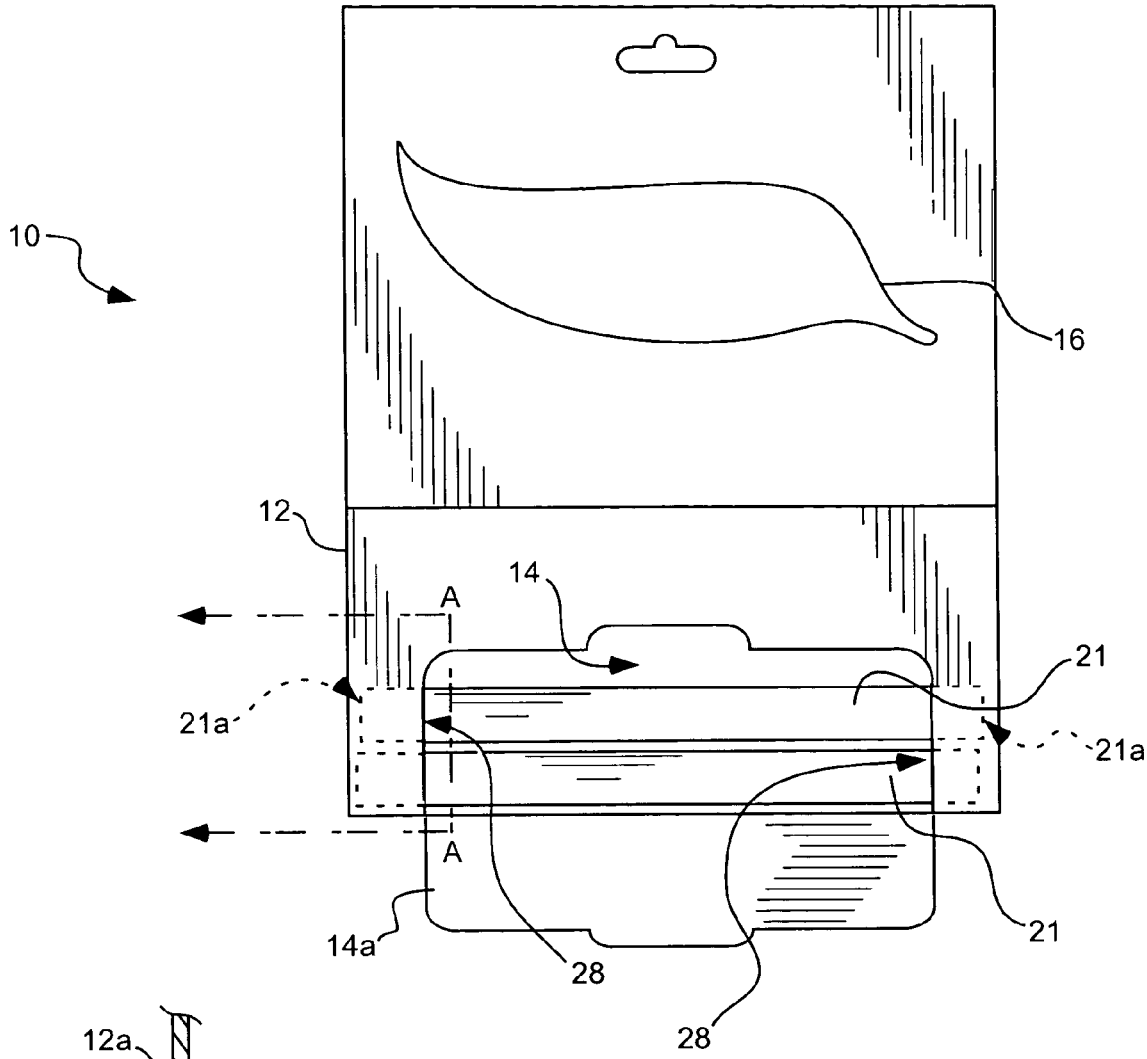
FIG. 3 is a front view of the container of FIG. 1 with an access opening formed therein.
Figure 3A:
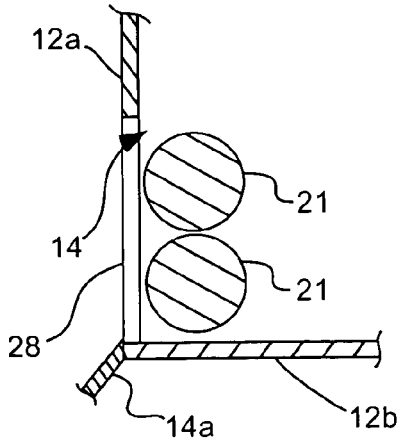
FIG. 3A is a side, cross-sectioned view of a container and product packets in accordance with an embodiment of the invention taken along section A—A of FIG. 3.

In one aspect of the invention, shown in detail in FIGS. 3 and 3A (FIG. 3A taken along section A—A of FIG. 3), the enclosure 12 can include a product that has been packaged in individual, cylindrical packets 21, each contained within the enclosure. In this aspect of invention, a pair of retaining ledges 28 can be formed on opposite sides of the access opening 14. The packets can each include ends 21*a* which are supported by the pair of retaining ledges to retain the packets within the enclosure. Thus, once the access opening 14 is formed, for example by separating flap 14*a* from the opening, the packets of product are held within the enclosure by the retaining ledges. When it is desired to dispense one of the packets of product, a consumer can merely grasp a packet with his or fingers and extract the packet through the opening and past the retaining ledges. In this manner, the packets can be retained within the enclosure until it is desired to dispense one or more of the packets.

While the access opening 14 is shown in FIG. 3 as being formed primarily in the front side 12*a* of the enclosure 12, it is to be understood that the opening can be formed in a variety of locations about the container, i.e., near a top of the container, a bottom or a side of the container, etc. Also, more than one access opening can be formed in the container and can be located in a variety of horizontal and vertical positions relative to the dimensions of the container. In one aspect of the invention (not shown) the access opening is formed in a bottom side 12*b* and the front side 12*a* of the enclosure. Retaining ledges can be utilized in this aspect of the invention as well, to aid in retainer the product within the container, similar to the embodiment illustrated in, and discussed in connection with, FIGS. 3 and 3A. The access opening can be formed in the container in a variety of manners known to those skilled in the art and can include means for temporarily closing the access opening. The means for temporarily closing the access opening can include, for example, oversized tabs formed in the access flap 14*a* which can fitted within slots formed in the container.

The product contained by the container can be disposed within the container in a variety of manners. As discussed above, in one aspect of the invention, the product is packaged within individual packets which can be configured in a cylindrical shape. The cylindrical packets can be disposed in the container in a vertical, horizontal, or slanted orientation. In addition, the packets can be shaped in a rectangular configuration, sheet form, etc., each of which can be oriented in the container in a variety of manners. In addition, more than one type or formulation of product can be contained within a single container. In this aspect of the invention, two or more compartments can be formed within the container and each compartment can contain and dispense a different type or formulation of product. For example, three compartments can be formed within the container and each compartment can dispense a different flavor of beverage. Also, a different type of medication can be contained and dispensed from each of a different compartment within the container.

The container 10 and/or enclosure 12 can be formed from a variety of materials. In one aspect of the invention the container and/or enclosure can be formed from paperboard box material. Other materials, such as cardboard, metals, paper products of various forms, and polymers can also be used to form the container and/or enclosure. It is contemplated that the size and shape of the container or enclosure can take a variety of shapes, as would occur to one skilled in the art, including cylindrical, rectangular, square, etc.

In addition to the individual containers shown and discussed herein, the present invention can also provide a plurality of containers, each container having a magnet re-usably attached thereto. Each magnet can differ from other of the magnets in a variety of manners. In one aspect of the invention, each magnet can differ from other of the magnets in at least one of: an indicia disposed thereon; and a decorative shape in which the magnet is formed. This feature of the invention can be utilized in the embodiment discussed above in which collectable magnets are provided and consumers can collect each of a variety of styles of magnets from a variety of related containers for decorative and/or entertainment purposes.

In one aspect of the invention, the magnet re-usably attached to the enclosure can include at least two configurations, including a support configuration shown in FIG. 2 in which the magnet 16 is non-magnetically attached to the container 10 and magnetically affixes the container to the support surface 13. The magnet can include a second, decorative or promotional configuration, shown in FIGS. 4A through 4C, in which the magnet 16 is removed from the enclosure and is magnetically affixed to the support surface 13 without the enclosure as a decorative or promotional magnet independent from the enclosure. In this manner, the magnet can be used by consumers for a variety of purposes after being removed from the container, including to affix notes, photos, tickets, artwork, etc., to the support surface.

In addition to the structural elements of the invention discussed above, the present invention also provides a method for promoting a product contained in a container, including the steps of: magnetically affixing the container to a support surface with a magnet re-usably and non-magnetically attached to the container, said magnet having indicia disposed thereon conveying information relating to the product; removing the container from the support surface after use of the container; removing the magnet from the container; and magnetically affixing the magnet to the support surface independently of the container to display the indicia conveying information relating to the product to promote the product in absence of the container.

The method can include the further step of removing an individual package of the product from the container and consuming the product.

The method can include the further steps of magnetically affixing a second container to the support surface with a second magnet re-usably and non-magnetically attached to the second container, said second magnet having a second indicia disposed thereon conveying information relating to a second product; removing the second container from the support surface after use of the second container; removing the second magnet from the second container; and magnetically affixing the second magnet to the support surface independently of the second container to display the second indicia conveying information relating to the product to promote the second product in absence of the second container.

The present invention also provides a method for promoting a product, including the steps of: disposing the product within a container, the container having an access opening in at least one side of the container to provide access to the product within the container; and re-usably attaching a magnet to the container to enable the container to be magnetically affixed to a support surface; the magnet having indicia disposed thereon conveying information relating to the product and having at least two configurations: i) a support configuration in which the magnet is non-magnetically attached to the container and magnetically affixes the container to the support surface; and ii) a decorative configuration, in which the magnet is removed from the container and is magnetically affixed to the support surface without the container as a decorative magnet independent from the container.

The method can include the further steps of magnetically affixing a second magnet re-usably attached to a second container to the support surface, said second magnet having a second indicia disposed thereon conveying information relating to a second product; removing the second container from the support surface after use of the second container; removing the second magnet from the second container; and magnetically affixing the second magnet to the support surface independently of the second container to display the second indicia conveying information relating to the product to promote the second product in absence of the second container.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A product container configured to be magnetically affixed to a support surface to contain and dispense a product in a location adjacent to the support surface, comprising:

an enclosure, configured to contain the product and to provide for dispensing of the product therefrom;

an access opening formed in at least one side of the enclosure, the access opening being configured to provide access to the product to allow an individual to withdraw the product from the enclosure; and a magnet, removably attached to the enclosure and being configured to magnetically affix the enclosure to the support surface;

the magnet having indicia disposed thereon, the indicia conveying information relating to the product.

2. The container of claim 1, wherein the magnet includes a decorative shape.

3. The container of claim 2, wherein the decorative shape is a shape selected from the group consisting of: a logo, a plant, an animal, a portion of a plant, a portion of an animal, a tea leaf, and a curvilinear closed shape.

4. The container of claim 2, further comprising a plurality of magnets removably attached to the enclosure, at least one of the magnets having a decorative shape.

5. The container of claim 1, further comprising:

a product packaged in individual, cylindrical packets contained in the enclosure; and a pair of retaining ledges formed on opposite sides of the access opening;

wherein ends of the cylindrical packets are supported by the pair of retaining ledges to retain the packets within the enclosure.

6. The container of claim 1, further comprising a plurality of containers, each container having a magnet removably attached thereto, each magnet differing from other of the magnets in at least one of: an indicia disposed thereon; and a decorative shape in which the magnet is formed.

7. The container of claim 1, wherein the magnet includes indicia disposed on at least two sides of the magnet.

8. A product container configured to be magnetically affixed to a support surface to contain and dispense a product in a location adjacent to the support surface, comprising:

a magnet, removably attached to the container and being configured to magnetically affix the container to the support surface;

the magnet having indicia disposed thereon, the indicia conveying information relating to the product;

an enclosure, configured to contain the product and to provide for dispensing of the product therefrom; and an access opening formed in at least one side of the enclosure, the access opening being configured to provide access to the product to allow an individual to withdraw the product from the enclosure.

9. A product container configured to be magnetically affixed to a support surface to contain and dispense a product in a location adjacent to the support surface, comprising:

an enclosure, configured to contain the product and to provide for dispensing of the product therefrom;

an access opening formed in at least one side of the enclosure; and a magnet, removably attached to the enclosure, the magnet having at least two configurations;

i) a support configuration in which the magnet is non-magnetically attached to the enclosure and magnetically affixes the enclosure to the support surface; and ii) a decorative configuration, in which the magnet is removed from the enclosure and is magnetically affixed to the support surface without the enclosure as a decorative magnet independent from the enclosure.

10. The container of claim 9, wherein the magnet includes a decorative shape.

11. The container of claim 10, wherein the decorative shape is a shape selected from the group consisting of: a logo, a plant, an animal, a portion of a plant, a portion of an animal, a tea leaf, and a curvilinear closed shape.

12. The container of claim 9, further comprising:

a product packaged in individual, cylindrical packets contained in the enclosure; and a pair of retaining ledges formed on opposite sides of the access opening;

wherein ends of the cylindrical packets are supported by the pair of retaining ledges to retain the packets with in the enclosure.

13. The container of claim 9, further comprising a plurality of containers, each container having a magnet reusably attached thereto, each magnet differing from other or the magnets in at least one of: an indicia disposed thereon; and a decorative shape in which the magnet is formed.

14. The container of claim 9, wherein the magnet includes indicia disposed on at least two sides of the magnet.

* * * * *